US007513073B1

(12) United States Patent
Smith

(10) Patent No.: US 7,513,073 B1
(45) Date of Patent: Apr. 7, 2009

(54) KIT FOR SIGNAGE SUSPENSION

(76) Inventor: Kevin Scott Smith, 12206 Chase St., Crown Point, IN (US) 46307

( * ) Notice: Subject to any disclaimer, the term of this patent is extended or adjusted under 35 U.S.C. 154(b) by 0 days.

(21) Appl. No.: 12/101,535

(22) Filed: Apr. 11, 2008

(51) Int. Cl.
*G09F 7/00* (2006.01)

(52) U.S. Cl. ..... 40/623; 40/607.05

(58) Field of Classification Search ..... 40/623, 40/607.01, 607.05, 607.06, 611.01, 611.02, 40/617; 135/120.04; 248/353, 61; 24/130
See application file for complete search history.

(56) References Cited

U.S. PATENT DOCUMENTS

| | | | | | |
|---|---|---|---|---|---|
| 340,788 | A * | 4/1886 | Jory | 40/623 |
| 1,077,514 | A * | 11/1913 | Everett | 40/623 |
| 1,505,034 | A * | 8/1924 | Kussner | 52/712 |
| 2,029,908 | A * | 2/1936 | Bleeker, Jr. | 40/624 |
| 2,252,764 | A * | 8/1941 | Oberlin | 40/604 |
| 2,911,746 | A * | 11/1959 | Frey | 40/604 |
| 4,553,358 | A * | 11/1985 | Deike | 52/98 |
| 4,926,592 | A * | 5/1990 | Nehls | 52/98 |
| 5,848,502 | A * | 12/1998 | Schaefer | 52/165 |
| 2007/0209165 | A1 * | 9/2007 | Sorensen et al. | 24/130 |

* cited by examiner

*Primary Examiner*—Cassandra Davis
(74) *Attorney, Agent, or Firm*—MacMillan, Sobanski & Todd, LLC

(57) ABSTRACT

A kit for suspending a sign is disclosed herein. The kit includes first and second column anchors operable to be permanently mounted in the ground or concrete. The kit also includes first and second columns individually receivable in one of the respective first and second column anchors. The first and second columns can be selectively removed when it is no longer desired to suspend a sign. Each of the first and second columns has a plurality of through-apertures. The kit also includes a plurality of bushings. An individual bushing is received in one of the through-apertures. The kit also includes a quantity of rope extending through the plurality of bushings when the kit is assembled. The kit also includes at least one rope tensioning member operable to engage both of the first and second ends of the rope for holding the rope taut.

4 Claims, 2 Drawing Sheets

KIT FOR SIGNAGE SUSPENSION

BACKGROUND OF THE INVENTION

1. Field of the Invention

The invention relates to a kit for suspending a sign or banner.

2. Description of Related Prior Art

Signs and banners can be used by businesses, schools, individuals, and groups of all kinds to convey information. Signs are often positioned in elevated relation relative to the intended observers of the sign. Signs can also be suspended outside and vulnerable to wind. In order to best convey information, a sign should be taut when suspended.

SUMMARY OF THE INVENTION

In summary, the invention is a kit for suspending a sign. The kit includes first and second column anchors operable to be permanently mounted in the ground or concrete. The kit also includes first and second columns individually receivable in one of the respective first and second column anchors. The first and second columns can be selectively removed when it is no longer desired to suspend a sign. Each of the first and second columns has a plurality of through-apertures. The kit also includes a plurality of bushings. An individual bushing is received in one of the through-apertures. The kit also includes a quantity of rope extending through the plurality of bushings when the kit is assembled. The kit also includes at least one rope tensioning member operable to engage both of the first and second ends of the rope for holding the rope taut.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EXEMPLARY EMBODIMENT

While those in the field of signage suspension have been satisfied by existing suspension systems, I have perceived the state of the art lacking. In an exemplary embodiment of my invention, a kit 10 can suspend a sign tautly and can do so repeatedly. My kit 10 is easy to use and yet provides consistently good results.

A kit 10 according to the exemplary embodiment of my invention includes first and second column anchors 12, 14 operable to be permanently mounted in the ground or concrete. The portion of ground or concrete surrounding anchor 12 has been removed to show the structural details of the exemplary anchor 12, such as at least one fin. The kit 10 also includes first and second columns 16, 18 individually receivable in one of the respective first and second column anchors 12, 14. The first and second columns 16, 18 are selectively removable from the first and second column anchors 12, 14.

The Allied Tube & Conduit Company markets a line of products sold under the name Telespar® that can be used to practice the invention. U.S. Pat. No. 6,343,446 is assigned to Allied and discloses an anchor that can be used to practice the invention. However, other manufacturers may be able to produce products that can be used to practice alternative embodiments of the invention. For example, the first and second columns 16, 18 are illustrated as square, but square columns are not required to practice the invention.

The tops of the anchors 12, 14 can be flush with the ground or be elevated relative to the surrounding surface. For example, the anchors 12, 14 can project from the ground and define through-apertures that align with through-apertures of the columns 16, 18. A locking device can be inserted in the aligned through-apertures to prevent unauthorized separation of the anchors 12, 14 and columns 16, 18. The columns 16, 18 extend a sufficient distance into the anchors 12, 14 to ensure a desired level of rigidity for the columns 16, 18.

Figure 1:
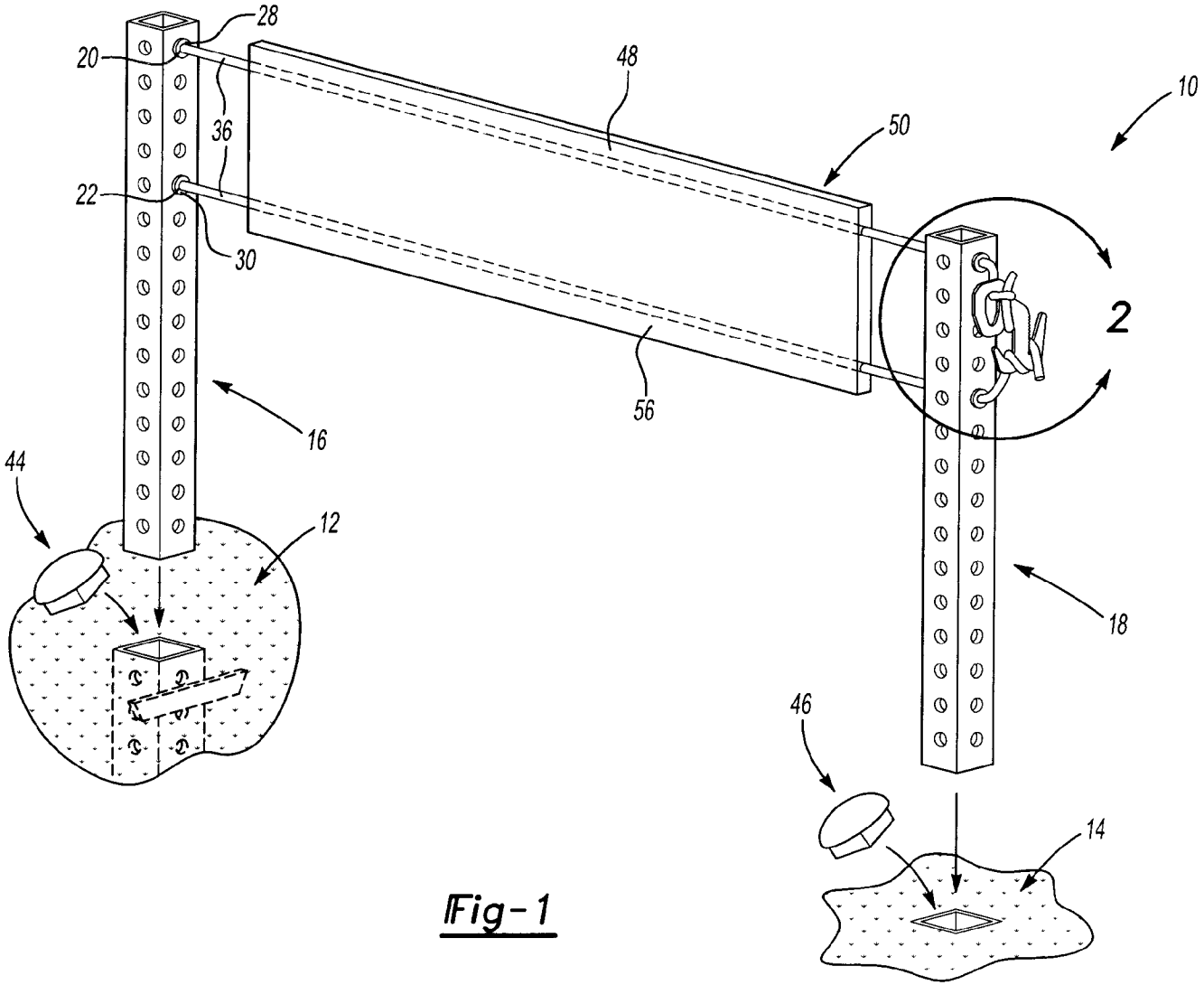
FIG. 1 is a partially exploded view of a kit according to the exemplary embodiment of the invention.
Figure 2:
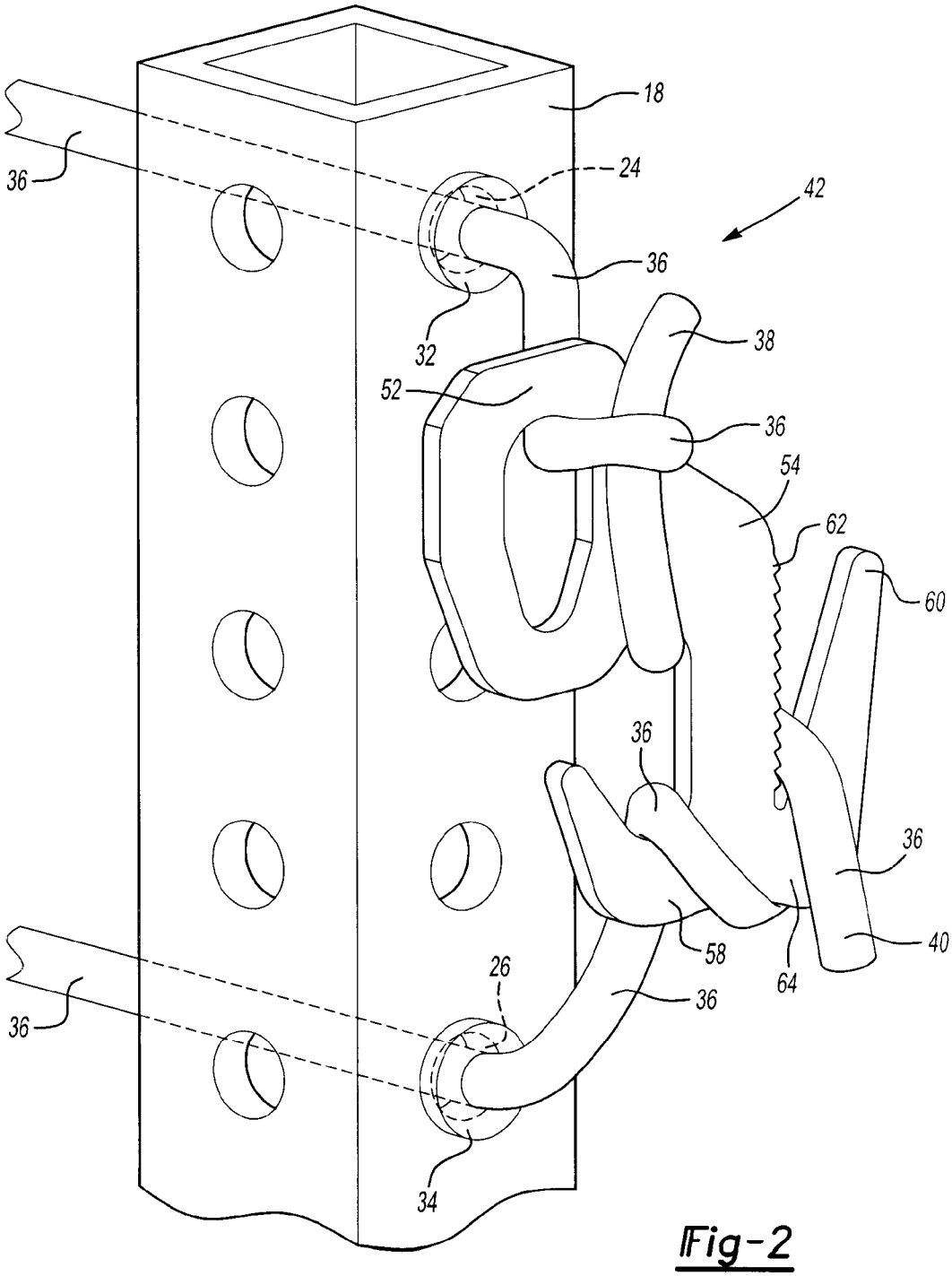
FIG. 2 is a detail view based on the detail arrow 2 in FIG. 1.

Each of the first and second columns 16, 18 has a plurality of through-apertures such as through-apertures 20, 22, 24, 26. The illustrated first and second columns 16, 18 define numerous un-used through-apertures; the invention can be practiced with first and second columns 16, 18 that define only used through-apertures. The through apertures 24 and 26, referenced in FIG. 2 are hidden because the kit 10 also includes a plurality of bushings 28, 30, 32, 34. Each of the bushings 28, 30, 32, 34 is individually received in one of the through-apertures 20, 22, 24, 26. The exemplary bushings 28, 30, 32, 34 are each shown as extending through both ends of the through-apertures 20, 22, 24, 26; however, in alternative embodiments of the invention, the bushings can be halved such that eight bushings are used instead of four.

The kit 10 also includes a quantity of rope 36 extending between first and second ends 38, 40. The rope 36 is sufficiently long to at least twice traverse a distance defined between the first and second columns 16, 18 when the first and second columns 16, 18 are positioned in the first and second column anchors 12, 14. The rope 36 passes through the plurality of bushings 28, 30, 32, 34.

The kit 10 also includes a rope tensioning member 42 operable to engage both of the first and second ends 38, 40 of the rope 36 for holding the rope 36 taut. In the exemplary embodiment of the invention, the rope tensioning member 42 is anchor-like and is marketed by the Nite Ize, Inc. company of Boulder, Colo., and designated as a "Carabiner FIG. 9". In alternative embodiments of the invention, the rope tensioning member 42 can be a different structure.

The exemplary kit 10 also includes first and second caps 44, 46 individually receivable in one of the respective first and second column anchors 12, 14. The caps 44, 46 are selectively removable from the first and second column anchors 12, 14. The caps 44, 46 can be desirable to cover the openings first and second column anchors 12, 14 when the first and second column 16, 18 are being stored. The caps 44, 46 can be designed in a way to prevent easy removal from the first and second column anchors 12, 14. For example, the caps 44, 46 can be magnetic. Alternatively, the caps 44, 46 can include a locking structure similar to locks for gasoline caps. The tops of the caps 44, 46 can be rounded to reduce the likelihood that caps 44, 46 will cause a person to trip over them. The kit 10 can also include driving caps (not shown) to drive the first and second column anchors 12, 14 into the ground without damage.

In one exemplary operation for assembling the exemplary kit 10, the caps 44, 46 can be removed from the anchors 12, 14. The columns 16, 18 can then be inserted in the anchors 12, 14, respectively. The first end 38 of the rope 36 can then be directed through the bushing 28 mounted in the through-aperture 20 of the column 16. The first end 38 can then be directed through a sleeve 48 of a sign 50. The first end 38 can then be directed through the bushing 32 mounted in the through-aperture 24 of the column 18. The first end 38 can then be directed through a loop portion 52 of the rope tensioning member 42 and firmly tied to a shank portion 54 of the rope tensioning member 42.

Concurrently or sequentially, the second end 40 of the rope 36 can be directed through the bushing 30 mounted in the through-aperture 22 of the column 16. The first end 38 can then be directed through a sleeve 56 of the sign 50. The second end 40 can then be directed through the bushing 34 mounted in the through-aperture 26 of the column 18. The second end 40 can then be directed around arm portions 58, 60 of the rope tensioning member 42. The second end 40 can first be drawn over the arm portion 58 to achieve desired tautness in the rope 36 and the sign 50. The second end 40 can then be wrapped around the crown 64 of the anchor-like rope tensioning member 42 and pulled downward over the arm portion 60. The shank portion 54 includes teeth 62 projecting toward the arm portion 60. The teeth 62 snare the second end 40 to maintain the tautness of the rope 36. It is noted that the kit 10 could be assembled in different ways.

The kit of the present invention provides a reusable system for displaying signs. At the same time, the kit of the present invention provides a robust system that can repeatedly display signs in a taut manner. The kit of the present invention provides a system that is easy to assemble and tear down. The kit of the present invention is relatively small and easy to store. The anchors can remain in place year-round, the caps serving to protect the interiors of the anchors from erosion and also serving to readily identify the positions of the anchor when the kit is to be assembled.

An alternative embodiment of the invention could be practiced with two pieces of rope sewn into the banner (each of the two ropes being sewn to the banner). In such an embodiment, two rope tensioning members could be used, one on each side of the banner.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A kit for suspending a sign comprising:

first and second column anchors operable to be permanently mounted in the ground or concrete;

first and second columns individually receivable in one of the respective first and second column anchors and selectively removable and each having a plurality of through-apertures;

a plurality of bushings each individually received in one of the through-apertures;

a quantity of rope operable to pass through the through-apertures and the plurality of bushings; and at least one rope tensioning member operable to engage the rope for holding the rope taut.

2. The kit of claim 1 further comprising:

first and second caps individually receivable in one of the respective first and second column anchors and selectively removable, the first and second column anchors receiving the first and second caps when the first and second columns have been removed.

3. The kit of claim 1 wherein said quantity of rope is further defined as extending between first and second ends and sufficiently long to at least twice traverse a distance defined between the first and second columns when the first and second columns are positioned in the first and second column anchors.

4. A kit for conveying information comprising:

first and second column anchors operable to be permanently mounted in the ground or concrete;

first and second columns individually receivable in one of the respective first and second column anchors and selectively removable and each having a plurality of through-apertures;

a plurality of bushings each individually received in one of the through-apertures;

a quantity of rope extending between first and second ends and sufficiently long to at least twice traverse a distance defined between the first and second columns when the first and second columns are positioned in the first and second column anchors, the rope passing through the plurality of bushings;

a sign having first and second sleeves wherein the rope is operable to extend through the first and second sleeves; and a rope tensioning member operable to engage both of the first and second ends of the rope for holding the rope taut.

* * * * *